US005932325A

United States Patent [19]

Ebihara et al.

[11] Patent Number: 5,932,325

[45] Date of Patent: Aug. 3, 1999

[54] THERMAL TRANSFER RECORDING MATERIAL FOR IMPARTING METALLIC LUSTER AND USE THEREOF

[75] Inventors: Shunichi Ebihara; Keiji Hirose, both of Tokyo-To, Japan

[73] Assignee: Dai Nippon Printing Co., Ltd., Japan

[21] Appl. No.: 08/662,633

[22] Filed: Jun. 13, 1996

[30] Foreign Application Priority Data

| | | | |
|---|---|---|---|
| Jun. 16, 1995 | [JP] | Japan | 7-173032 |
| Jul. 19, 1995 | [JP] | Japan | 7-204074 |
| Jul. 31, 1995 | [JP] | Japan | 7-213066 |

[51] Int. Cl.[6] ..... B41M 5/00

[52] U.S. Cl. ..... 428/209; 428/195; 428/344; 428/348; 428/349; 428/354; 428/355 AC; 428/484; 428/500; 428/522; 428/913; 428/914

[58] Field of Search ..... 156/233; 428/195, 428/209, 484, 488.1, 488.4, 500, 522, 913, 914, 343, 344, 346–349, 354, 355 AC

[56] References Cited

U.S. PATENT DOCUMENTS

| | | | |
|---|---|---|---|
| 4,875,961 | 10/1989 | Oike et al. | 156/234 |
| 4,892,602 | 1/1990 | Oike et al. | 156/233 |
| 4,987,006 | 1/1991 | Williams | 427/53.1 |
| 5,338,612 | 8/1994 | Kawaguchi | 428/412 |
| 5,525,403 | 6/1996 | Kawabata et al. | 428/212 |

OTHER PUBLICATIONS

Patent Abstracts of Japan, vol. 17, No. 430 (M–1460), Aug. 10, 1993 & JP 05 092672 A (Toppan Printing K.K.), Apr. 16, 1993, *abstract*.

Patent Abstracts of Japan, vol. 14, No. 563 (M–1058), Dec. 14, 1990 & JP 02 238994 A (Toppan Printing K.K.), Sep. 21, 1990, *abstract*.

Patent Abstracts of Japan, vol. 12, No. 241 (M–716), Jul. 8, 1988 & JP 63 030288 A (Toppan Printing K.K.), Feb. 8, 1988, *abstract*.

*Primary Examiner*—Bruce H. Hess
*Attorney, Agent, or Firm*—Parkhurst & Wendel, L.L.P.

[57] ABSTRACT

A thermal transfer recording material for imparting metallic luster, comprising: a substrate; and at least a layer having metallic luster and optionally an adhesive layer provided in that order on one surface of the substrate, an ink-receptive layer being provided between the layer having metallic luster and the substrate.

4 Claims, 1 Drawing Sheet

THERMAL TRANSFER RECORDING MATERIAL FOR IMPARTING METALLIC LUSTER AND USE THEREOF

TECHNICAL FIELD

The present invention relates to a technique for providing records having a color image, having metallic luster, such as a letter, a figure or an image with gradation. In particular, the present invention relates to a thermal transfer recording material for imparting such metallic luster and a color-image forming method and a record using the same.

BACKGROUND OF THE INVENTION

Hot stamping by using a transfer foil having a layer of a metal film, such as a deposited metal film, has hitherto been used as a method for forming a record having metallic luster. In general, the transfer foil has a construction comprising a substrate film and, laminated thereon in the following order, a release layer, an anchor layer for deposition, a layer of a metal film, and an adhesive layer, or a construction comprising the same elements as described above, except that the release layer is designed so as to function also as the anchor layer for deposition and the provision of the anchor layer for deposition is omitted. In this method, a preheated hot stamp is pressed against the transfer foil through the substrate film to achieve printing (recording).

In printing (recording) by hot stamping, however, a stamp made of a material, such as a metal, having a relief having the same configuration as a letter, a figure or the like to be printed should be prepared. This renders the hot stamping method cost-ineffective for printing, wherein the number of prints is small, and, in addition, renders the stamping method complicate from the technical viewpoint. The color of records prepared by hot stamping may be generally varied by varying a colorant, such as a dye or a pigment, incorporated into the anchor layer. In this case, however, when the formation of a multi-color record having metallic tone (metallic luster), wherein a plurality of colors are provided in a single record, is contemplated, a transfer foil having a desired color and a desired stamp should be prepared for each color, resulting in a complicated recording process.

On the other hand, in recent years, a thermal transfer recording process using a thermal transfer ribbon, such as a melt type thermal transfer ribbon or a sublimation type thermal transfer ribbon, and a thermal head has spread in the art. This process is suitable also for printing wherein the number of prints is small. Further, it is also possible to conduct multi-color recording using an ink ribbon of any desired color or full-color recording by subtraction color mixing using three colors of yellow (Y), magenta (M), and cyan (C)(i.e., YMC) or, if necessary, four colors of yellow (Y), magenta (M), cyan (C), and black (Bk) (i.e., YMCBk).

However, in the formation of a multi-color or full-color record having metallic luster in the same manner described above in connection with the conventional transfer foil, when a transfer ribbon, for example, for YMC, with yellow, magenta, and cyan dyes being incorporated into the anchor layer for deposition is used, printing of a deposited metal layer for one color followed by printing of the deposited metal layer for another color poses a problem that the later deposited metal layer hides the earlier printed color in an overlapped area. For this reason, the above process can neither reproduce a full-color image nor express a desired color.

DISCLOSURE OF THE INVENTION

Accordingly, an object of the present invention is to solve the above problems of the prior art and to provide a thermal transfer recording material suitable for the formation of a color image having metallic luster and a method for recording a color image having metallic luster using the same.

In order to solve the above problems and to attain the above object, the method for recording a color image having metallic luster according to the present invention essentially comprises first using a thermal transfer recording material, for imparting metallic luster, to form a transferred area having a layer with metallic luster on a recording material and then forming a recording layer of a desired color by a printing method such as thermal transfer using a thermal transfer ribbon, thereby preparing a color record, of a desired color, or a multi-color record having metallic luster (metallic tone).

Further, the selection of at least one color selected from three colors of YMC or four colors of YMCBk as a color for printing enables a full-color record having metallic tone (metallic luster) to be prepared with good reproduction.

Thermal transfer recording materials, for imparting metallic luster, usable in the above recording method can be classified into two types.

The first thermal transfer recording material for imparting metallic luster according to the present invention comprises a substrate; and at least a layer, having metallic luster, of a metal film, such as a deposited metal or a plating, and an adhesive layer provided in that order on one surface of the substrate, an ink-receptive layer being provided between the layer having metallic luster and the substrate. In the thermal transfer recording material for imparting metallic luster, an anchor layer is preferably provided between the layer having metallic luster and the substrate. Further, in the thermal transfer recording material for imparting metallic luster, the ink-receptive layer is preferably a layer which functions also as the anchor layer. Furthermore, in the thermal transfer recording material for imparting metallic luster, the ink-receptive layer is preferably receptive to a sublimation type thermal transfer ink or a melt type thermal transfer ink.

The second thermal transfer recording material for imparting metallic luster according to the present invention comprises a substrate; and at least a layer, having metallic luster, formed of a resin with a pigment having metallic luster dispersed therein and an adhesive layer provided in that order on one surface of the substrate, an ink-receptive layer being provided between the layer having metallic luster and the substrate. In this thermal transfer recording material for imparting metallic luster, the resin constituting the ink-receptive layer is preferably receptive to a sublimation type thermal transfer ink or a melt type thermal transfer ink.

The recording method according to the present invention comprises transferring at least one desired color as a sublimation type transfer ink and/or a melt type thermal transfer ink onto a transferred area formed by transferring a layer, having metallic luster, using the above thermal transfer recording material for imparting metallic luster, thereby preparing a color record or a multi-color record having metallic luster, or further transferring at least one color selected from yellow (Y), magenta (M), cyan (C), and black (Bk), thereby preparing a full-color record having metallic luster.

The transparency of record layers formed by the YMC-based inks is not less than 70% in the wavelength range of from 550 to 780 nm for the yellow ink layer, not less than 70% in the wavelength range of from 380 to 450 nm and in the wavelength range of from 600 to 780 nm for the magenta ink layer, and not less than 70% in the wavelength range of from 380 to 550 nm for the cyan ink layer.

The record according to the present invention has metallic luster imparted by the above recording method.

BEST MODE FOR CARRYING OUT THE INVENTION

The thermal transfer recording material for imparting metallic luster and recording method and record according to the present invention will be described.

Thermal Transfer Recording Material for Imparting Metallic Luster

Figure 1:
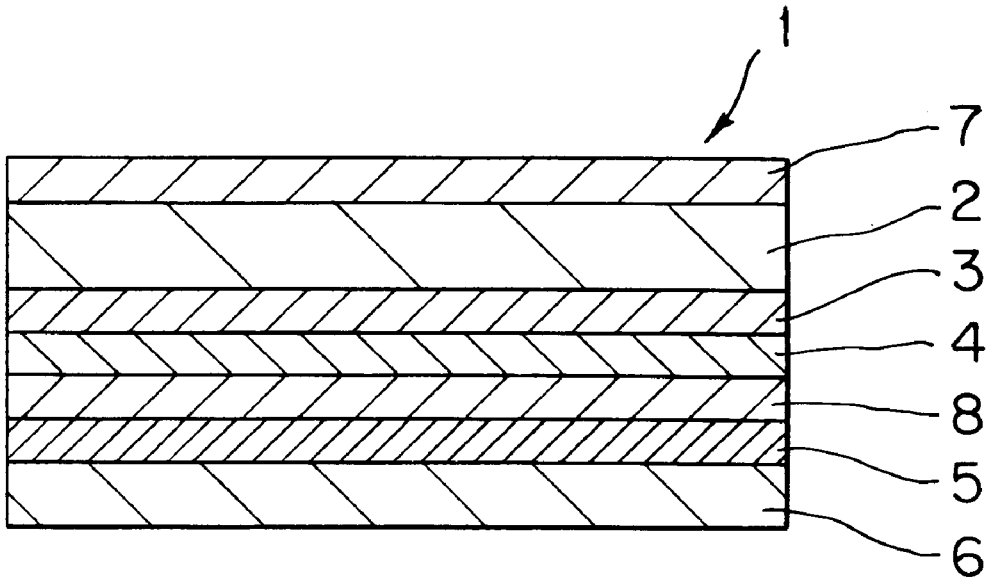
FIGS. 1 and 2 are cross-sectional views of thermal transfer recording materials for imparting metallic luster according to the present invention.

FIG. 1 is a vertical section of one embodiment of the thermal transfer recording material for imparting metallic luster according to the present invention, wherein a layer of a metal film is used as a layer having metallic luster. A thermal transfer recording material 1 for imparting metallic luster according to the present invention shown in FIG. 1 comprises a substrate 2; a back surface layer 7 provided on the back surface of the substrate 2; and a release layer 3, an ink-receptive layer 4, an anchor layer 8, a layer 5 having metallic luster, and an adhesive layer 6 provided in that order on the top surface of the substrate 2. The back surface layer 7, the anchor layer 8, and the release layer 3 may be optionally omitted. The ink-receptive layer 4 may be constructed so as to function also as the anchor layer 8, and vice versa.

When the layer having metallic luster is constituted by a layer of a metal film, it per se has poor receptivity to an ink. Therefore, in this case, the provision of an ink-receptive layer is preferred. The thermal transfer of this thermal transfer material for imparting metallic luster results in the formation of a transferred area wherein the layer having metallic luster is covered with the ink-receptive layer.

Figure 2:
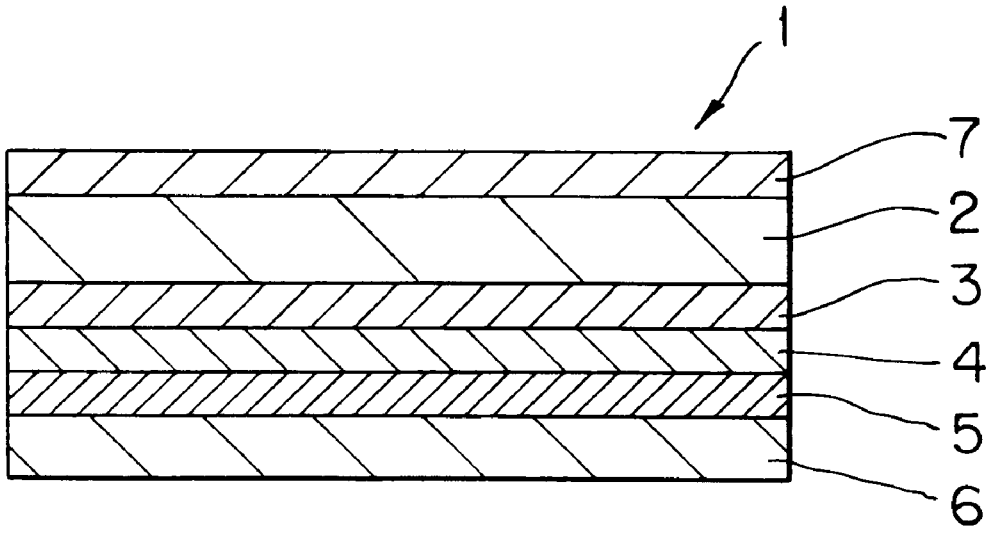

FIG. 2 is a vertical section of another embodiment of the thermal transfer recording material for imparting metallic luster according to the present invention, wherein a resin-containing layer with a pigment having metallic luster dispersed in the resin is used as the layer having metallic luster. A thermal transfer recording material 1 for imparting metallic luster shown in FIG. 2 comprises a substrate 2; a back surface layer 7 provided on the back surface of the substrate 2; and a release layer 3, an ink-receptive layer 4, a layer 5 having metallic luster, and an adhesive layer 6 provided in that order on the top surface of the substrate 2. As with the embodiment shown in FIG. 1, the back surface layer 7 and the release layer 3 may be optionally omitted.

The thermal transfer recording material for imparting metallic luster according to the present invention is constructed so that the transferred layer has receptivity to an ink. This is an important feature of the present invention.

When mere formation of a transferred layer having metallic luster is contemplated, coating of a substrate film with a coating liquid of a metallic powder, such as aluminum, copper or copper alloy, dispersed in wax or a resin as in the case of the conventional transfer foil, or a construction of a substrate film and a release layer, an anchor layer for deposition, a deposited metal layer, and an adhesive layer laminated in that order on the substrate film as in the case of the conventional transfer foil used in hot stamping suffices for attaining this purpose. Further, a variation of the latter construction is also possible wherein the release layer is designed so as to function also as the anchor layer for deposition in order to omit the provision of the anchor layer for deposition and a release layer, a deposited metal layer, and an adhesive layer is laminated in that order on a substrate film.

Although a full-color or multi-color record having metallic luster can be provided by using any one of ribbons having the above two constructions (wherein full-color or multi-color printing is conducted on a transferred area having metallic luster), the latter ribbon having a deposited metal layer is preferred from the viewpoint of providing a record having better metallic luster. In the above conventional transfer recording material, however, a curing resin is used in the anchor layer, for deposition, constituting the outermost layer of the transferred area in order to improve the scratch resistance, solvent resistance, and heat resistance, and, therefore, the additional provision of an ink layer on the transferred layer is not taken into consideration. For this reason, when a full-color or multi-color image is formed on a transferred area formed using the above conventional transfer recording material for imparting metallic luster, it is impossible to form good printed image. In particular, when overprinting is conducted using a melt type thermal transfer ink composed mainly of a wax, since the wax component is less likely to be compatible with the resin constituting the outermost layer of the transferred layer, problems occur such as unsatisfactory sensitivity, due to unsatisfactory transfer, and uneven printing due to flow of the wax during printing. Further, overprinting using a sublimation type thermal transfer ink poses problems including that, when the outermost layer of the transferred layer is not receptive to a dye, recording becomes impossible and the sublimation type thermal transfer ribbon and the transferred layer are heat-fused to each other during printing.

For the above reason, in the present invention, as illustrated in FIGS. 1 and 2, the thermal transfer recording materials for imparting metallic luster are constructed so as to provide a transferred area of which the outermost layer is receptive to an ink, thereby solving the problems of unsatisfactory sensitivity and uneven printing encountered in the melt type thermal transfer ink and the problems, associated with fixation of dyes and releasability of the recording material, encountered in the sublimation type thermal transfer ink. Further, when a melt type thermal transfer ink is used, the thermal transfer recording materials for imparting metallic luster are constructed so as to provide a transferred area of which the outermost layer is receptive to the melt type thermal transfer ink, while when a sublimation type thermal transfer ink is used, the thermal transfer recording materials for imparting metallic luster are constructed so as to provide a transferred area of which the outermost layer is receptive to the sublimation type thermal transfer ink. More specifically, in the transfer of the layer having metallic luster, the above receptivity to an ink can be imparted to the outermost layer of the transferred area by using a suitable resin as the resin constituting the ink-receptive layer which constitutes the outermost layer of a transferred layer formed on a transfer object by transfer from the thermal transfer recording material for imparting metallic luster.

The use of the thermal transfer recording material having the above construction enables melt type thermal transfer or sublimation type thermal transfer recording to be conducted on the transferred and printed area with very successful results, offering full-color or multi-color records having good metallic luster.

Further, it should be noted that a color ink used in an ink ribbon for the conventional single-color printing has low transparency and, when as such printed over the transferred area formed using the thermal transfer recording material for imparting metallic luster, is less likely to offer satisfactory transparency or metallic luster. For this reason, in the recording method and the record prepared using said recording method according to the present invention, the transparency of record layers formed by transfer of inks is preferably specified.

Materials for constituting individual layers will be described in more detail with reference to FIGS. 1 and 2.

Materials for constituting the substrate 2 for the thermal transfer recording material 1 for imparting metallic luster are not particularly limited and may be any conventional material commonly used in the conventional thermal transfer ribbons or the like so far as they can withstand heat from the thermal head during thermal transfer recording and has desired thermal conductivity, mechanical strength and other properties. Examples of materials usable for constituting the substrate include: films of plastics, such as polyester, polypropylene, polystyrene, cellophane, cellulose acetate, polycarbonate, polyvinyl chloride, polyvinylidene chloride, and polyimide; papers such as capacitor paper and paraffin paper; nonwoven fabrics; and laminates of these materials.

The thickness of the substrate may be varied so as to give suitable mechanical strength and thermal conductivity. It is preferably about 2 to 25 $\mu$m. Like one embodiment of the present invention shown in FIG. 1, a heat-resistant back surface layer 7 may be provided on the back surface of the substrate 2 from the viewpoint of preventing the thermal transfer recording material from being heat-fused to the thermal head. Further, slip properties in addition to the heat resistance may be imparted to the back surface layer 7.

In order for the back surface layer to have heat resistance, conventional heat-resistant resins, for example, thermosetting resins, such as melamine resin, and thermoplastic resins, such as silicone resins and fluororesins, may be used. On the other hand, in order to provide slip properties, additives such as fillers, lubricants, and antistatic agents may be added. The thickness of the back surface layer may be such that the prevention of fusing, the contemplated lubricity and the like can be attained. It is generally about 0.1 to 3 $\mu$m.

The release layer 3 is transferred entirely or partially due to cohesive failure in the thicknesswise direction thereof from the thermal transfer recording material, for imparting metallic luster, onto a transfer object and, as a result, constitutes the outermost surface of the resultant record. In the partial or entire transfer, low cohesive force at the time of recording is preferred from the viewpoint of good transferability of the ink. Alternatively, the release layer 3 may be one which is not transferred at all. What is required of the release layer is to separate the thermal transfer recording material for imparting metallic luster in the release layer or in a face adjacent to the release layer, thereby enabling the substrate to be separated from the other layers.

The release layer 3 may be formed of, for example, various waxes, such as carnauba wax, paraffin wax, microcrystalline wax, ester wax, Fischer-Tropsh wax, various low-molecular weight polyethylenes, Japan wax, beeswax, spermaceti, insect wax, wool wax, shellac wax, candelilla wax, petrolatum, partially modified wax, fatty acid esters, and fatty acid amides.

Further, besides the above waxes, resins may be used for constituting the release layer 3 so far as they have suitable releasability. The resin may be used alone or as a mixture thereof with the above wax.

Examples of such resins include rubber resins, such as polyisoprene rubber, styrene-butadiene rubber, and butadiene-acrylonitrile rubber, acrylic ester resins, polyvinyl ether resins, polyvinyl acetate resin, vinyl chloride/vinyl acetate copolymer resin, polystyrene resin, polyester resin, polyamide resin, polychlorinated olefin resin, polycarbonate resin, and polyvinyl butyral resin.

Further, if necessary, components such as softening agents and fillers may be additionally added.

The thickness of the release layer 3 is generally in the range of from 0.1 to 10 g/m$^2$. When the thickness is less than 0.1 g/m$^2$, the layer does not function as the release layer. On the other hand, when it exceeds 10 g/m$^2$, the transfer of an ink onto the ink-receptive layer is deteriorated and, in particular, no good record with gradation can be provided. Further, in this case, the integrity of the release layer is deteriorated, often rendering the release layer unusable.

The above material for the release layer generally has good compatibility with a melt type thermal transfer ink. Therefore, in this case, it does not hinder the transfer of the melt type thermal transfer ink onto the ink-receptive layer. On the other hand, in the case of a sublimation type thermal transfer ink, the release layer formed of particularly a wax often hinders the transfer of a sublimable dye onto the ink-receptive layer or causes fusing at the time of transfer. For this reason, when the sublimation type thermal transfer is contemplated, the material for the release layer should be carefully selected by taking the above matter into consideration.

The ink-receptive layer 4 is a layer which functions, as the outermost layer of the transferred area formed by transfer from the thermal transfer recording material for imparting metallic luster, to receive an ink thereon or in its interior, thereby promoting the formation of a record layer having good ink fixation. Therefore, preferably, a material compatible with the ink used is selected as the material for the ink-receptive layer.

When a melt type thermal transfer ink is used as the ink, the selection of a resin having good compatibility with a wax used in the melt type thermal transfer ink offers good ink transferability and good receptivity to the melt type thermal transfer ink. Resins having good receptivity to the melt type thermal transfer ink are thermoplastic resins, and particularly useful resins include polyalkylenes, such as polyethylene and polypropylene, ethylene/vinyl acetate copolymer, polyvinyl acetate, ionomer resin, acrylic resins, such as ethylene/ethyl acrylate copolymer and ethylene/acrylic acid copolymer, fibrous polymers, such as polyvinyl chloride, vinyl chloride/vinyl acetate copolymer, polyvinyl ether, polyvinyl acetal, polyvinyl butyral, polyvinyl alcohol, polyvinyl pyrrolidone, polyester, polyurethane, polyamide, ethyl cellulose, nitrocellulose, and cellulose acetate, and rubber polymers, such as chlorinated rubber and natural rubber. They may be used alone or in combination of two or more.

On the other hand, when a sublimation type thermal transfer ink is used as the ink, the use of a resin having good dyeability with the sublimable dye offers good receptivity to the sublimation type thermal transfer ink. Examples of resins useful for this purpose include polyester, polyacrylic ester, polycarbonate, polyvinyl acetate, styrene/acrylic ester copolymer, vinyltoluene/acrylic ester copolymer, polyurethane, polyamide, urea resin, polycaprolactone, polyvinyl chloride, vinyl chloride/vinyl acetate copolymer, and polyacrylonitrile.

Further, a resin having a combination of good receptivity to the sublimation type thermal transfer ink with good receptivity to the melt type thermal transfer ink may be used as a resin for both purposes.

Further, either of or both an ultraviolet absorber and a light stabilizer may be added to the resin in order to enhance the weather resistance of the transferred dye. Further, in order to improve the releasability from the sublimation type thermal transfer sheet at the time of recording, a release layer (to be transferred) may be formed, as an additional outermost layer for covering the as-transferred ink-receptive layer, between the release layer on the substrate and the ink-receptive layer. Alternatively, a release agent may be incorporated into the ink-receptive layer. Preferred release agents usable herein include solid wax, such as polyethylene wax, amide wax, Teflon powder, and surfactants, such as fluorosurfactants and phosphate surfactants, and silicone oil. When the release layer is formed, it constitutes the outermost layer after transfer. Therefore, the thickness of the release layer is made small, i.e., brought to about 0.1 to 1 $\mu$m, so that the transfer of dyes is not inhibited.

The ink-receptive layer is coated in a thickness in the range of from 0.1 to 20 g/m$^2$. When the thickness is less than 0.1 g/m$^2$, the wax in the melt type thermal transfer ink or the dye in the sublimation type thermal transfer ink cannot be satisfactorily fixed. On the other hand, when it exceeds 20 g/m$^2$, the sensitivity in printing (sensitivity in transfer) is remarkably deteriorated.

The anchor layer 8, when the layer having metallic luster is constituted by a deposited metal layer, functions as an anchor layer, for deposition, which provides a base at the time of deposition of a metal, protects the substrate, the ink-receptive layer and the like against heat at the time of deposition, and realize metallic luster. Further, at the time of transfer, the anchor layer, together with the deposited metal layer, is transferred onto a transfer object and located on and adhered to the transferred deposited metal layer to become one element, for constituting the transferred area, which serves also as a protective layer for improving mechanical and chemical resistance, such as scratch and corrosion resistance, of the deposited metal layer. Materials for the anchor layer are not particularly limited so far as they have transparency high enough for the metallic luster of the deposited metal layer to be seen through the anchor layer. Such materials include, for example, thermosetting resins, such as alkyd resin, phenolic resin, polyimide, epoxy resin, urethane resin, and unsaturated polyester resin, and thermoplastic resins, for example, olefin resins, such as polyethylene and polypropylene, acrylic resins, such as polymethyl methacrylate and polyacrylamide, styrene resins, such as polystyrene, vinyl resins, such as polyvinyl chloride and polyvinyl acetate, polyether resins, such as polyoxymethylene and polyphenylene oxide, polyvinyl butyral resin, nitrocellulose resin, and ethyl cellulose resin.

Thickness of the anchor layer is usually in the range of from 0.1 to 20 g/m$^2$ from the viewpoint of serving as a base layer for metal deposition or metal plating.

When the thickness is less than 0.1 g/m$^2$, the layer cannot function as the anchor layer, while when it exceeds 20 g/m$^2$, the transfer of the ink is deteriorated.

The ink-receptive layer 4 may serve also as the anchor layer 8, and vice versa. In this case, when a wax is used, the heat resistance at the time of deposition is unsatisfactory. Therefore, among the above resins, those having a relatively low molecular weight and low cohesive force are preferably used from the viewpoints of heat resistance, releasability from the substrate side, adhesion to the layer of a metal film, transferability of the ink and the like.

The layer 5 having metallic luster is constituted by a layer of a metal film, such as a deposited metal layer or a plating, or a resin-containing layer of a resin with a pigment having metallic luster, such as a metallic powder, dispersed therein. The layer of a metal film, particularly a deposited metal layer, is preferred because a record having excellent metallic luster can be provided. The plating poses a problem of troublesome process. It, however, offers good metallic luster as with the deposited metal layer.

The deposited metal layer is a layer of a metal film formed by metallization in vacuo, such as vacuum deposition or sputtering, that is, physical vapor deposition (PVD), of a metal, such as aluminum, zinc, tin, chromium, gold, or silver, or an alloy, such as brass. In the deposited metal layer, a thickness of 100 to 1000 Å, preferably in the range of from 300 to 600 Å, generally suffices for providing metallic luster. When the thickness is excessively small, the reflection of visible light is not sufficient for providing metallic luster, while excessively large thickness causes deteriorated transfer of the ink and is cost-ineffective.

The plating may be formed of nickel, chromium, copper, a noble metal, an alloy or the like. It may be formed by electroless plating of a resin film, which has been pretreated for plating, with the above metal. The thickness of the plating is preferably about 100 to 1000 Å.

The resin-containing layer is a layer formed of a resin with a metallic powder, such as aluminum, bronze, copper, tin, lead, or zinc powder, or a pigment having metallic luster, such as a pearl pigment, dispersed therein. Resins usable herein include thermoplastic resins, for example, ethylene resin, styrene-butadiene copolymer, acrylonitrile-butadiene copolymer, acrylic resin, and polyester resin, and other conventional resins.

The thickness of the resin-containing layer is preferably in the range of from 0.1 to 20 g/m$^2$ . When the thickness is less than 0.1 g/m$^2$, satisfactory metallic luster cannot be provided, while when it exceeds 20 g/m$^2$, the sensitivity is remarkably deteriorated.

The adhesive layer 6 may be formed of materials listed above as a wax component usable in the release layer, such as microcrystalline wax, carnauba wax, and paraffine wax, and thermoplastic resins, such as ethylene/vinyl acetate copolymer, which may be used alone or as a suitable mixture of two or more. The thickness of the adhesive layer is 0.1 to 10 g/m$^2$. When the thickness is less than 0.1 g/m$^2$, the adhesion is unsatisfactory, resulting in unsatisfactory sensitivity. On the other hand, when it exceeds 10 g/m$^2$, very large energy is necessary for melting the adhesive layer and, at the same time, the layer transferability is unfavorably deteriorated.

In the formation of a release layer, an ink-receptive layer, an anchor layer, a layer having metallic luster (resin-containing layer), or an adhesive layer on the substrate or the formation of a back surface layer on the back surface of the substrate, a material for constituting the layer may be dissolved or dispersed in a solvent, such as an organic solvent, to prepare a coating liquid which is then coated by gravure coating, gravure reverse coating, roll coating, knife coating or other various conventional coating means. In the case of a layer composed mainly of wax, it is also possible to use coating means such as hot-melt coating or hot-lacquer coating.

The thermal transfer recording material, for imparting metallic luster, having the above construction according to the present invention may be in itself used as a transfer foil in the conventional hot stamping process. Alternatively, it may be used as a thermal transfer ribbon for recording letters or the like of the metallic luster alone according to printing by means of a thermal head of a thermal printer used with the conventional thermal transfer ribbon. However, the thermal transfer recording material for imparting metallic luster according to the present invention can effectively exhibit its features in the formation of a record by transferring a layer having metallic luster from the thermal transfer recording material of the present invention and further forming a record layer of an ink (particularly a sublimation type thermal transfer ink or a melt type thermal transfer ink) on the resultant transferred area. The use of a plurality of different color inks can provide a multi-color record having metallic luster or a full-color record having metallic luster.

The form of the thermal transfer recording material having metallic luster may be, besides a ribbon, a sheet and the like and is not particularly limited.

Other preferred embodiments of the adhesive layer will be described in detail.

The adhesive layer should have good adhesion to both the layer having metallic layer and the transfer material. In general, resins such as polyvinyl acetate, polyacrylic ester, polyvinyl chloride, polyamide, polystyrene, polyurethane, and cyclized rubber have hitherto been extensively used in this field.

However, many of the above resins used for constituting the adhesive layer in the prior art have strong cohesive force and cause poor transferability of the ink, making it impossible to provide a halftone record, or have poor adhesion posing a problem of unsatisfactory sensitivity in printing, so that the transfer cannot be successfully performed by printing energy or printing pressure applied by a thermal head at the time of the thermal transfer printing. The incorporation of a wax into the adhesive layer is preferred in order to improve the sensitivity in printing. Many of the waxes have poor adhesion to the layer having metallic luster. The use of a mixture of the wax with the above resin is considered as means for solving this problem. However, the addition of the resin in such an amount as will provide satisfactory adhesion to the layer having metallic luster, poses a new problem that remarkable deterioration in sensitivity in printing or increased cohesive force of the whole adhesive layer occurs, deteriorating the transferability of the ink and, consequently, making it impossible to record a satisfactory halftone image.

Reducing the thickness of the anchor layer or the adhesive layer is considered effective as one of the means for improving the transferability of the ink. Regarding the thickness of the anchor layer, however, there is a limitation on the reduction in thickness of the anchor layer because the anchor layer is provided in order to offer metallic luster by deposition. In some cases, colorants are incorporated into the anchor layer for the purpose of providing a thermal transfer ribbon as a thermal transfer recording material having metallic luster of various color tones. In this case, a reduction in thickness of the anchor layer makes it impossible to provide a color tone having satisfactory density. Further, a reduction in thickness of the adhesive layer results in deteriorated sensitivity in printing due to unsatisfactory adhesion at the time of printing. Therefore, there is a limitation in the method of improving the transferability of the ink by reducing the thickness of the anchor layer or the adhesive layer, and, hence, such method is not realistic.

In order to improve the adhesion, increasing the thickness of the adhesive layer is also considered effective. In the case of conventional resins commonly used in the art, as described above, the adhesive layer having increased thickness causes deteriorated transferability of the ink.

The formation of the adhesive layer using a composition containing a wax and, in addition, at least one component selected from the group consisting of an ethylene/acrylic acid copolymer, an ethylene/methacrylic acid copolymer, and an ethylene/vinyl acetate copolymer is preferred from the viewpoint of solving the above problem.

More preferably, the total content of the at least one component selected from the group consisting of an ethylene/acrylic acid copolymer, an ethylene/methacrylic acid copolymer, and an ethylene/vinyl acetate copolymer is 10 to 50% by weight based on the total weight of the adhesive layer.

Further, the weight-average molecular weight of each of the at least one member selected from the group consisting of an ethylene/acrylic acid copolymer, an ethylene/methacrylic acid copolymer, and an ethylene/vinyl acetate copolymer is preferably 1000 to 100000, more preferably 5000 to 20000.

The above-described microcrystalline wax, carnauba wax, paraffine wax and the like are preferably used as the wax component for constituting the adhesive layer. This wax is used in combination with the following thermoplastic resin. Specifically, thermoplastic resins which are preferably usable as a component of the adhesive layer include ethylene/acrylic acid copolymer, ethylene/methacrylic acid copolymer, and ethylene/vinyl acetate copolymer. Preferably, at least one copolymer selected from the above compounds is used in combination with the wax used for constituting the adhesive layer.

All the above copolymers are copolymers of ethylene with other comonomers. From the viewpoints of offering a good balance between the adhesion to a metal, antiblocking properties and the like, the comonomer weight ratio is preferably such that the content of the ethylene in the copolymer is 50 to 95 based on 100 of the total weight of the copolymer.

Regarding the mixing ratio of the copolymer to the wax in the adhesive layer is preferably such that the total content of the copolymer is 10 to 50% by weight based on the total weight of the adhesive layer. When the total content of the copolymer is less than 10%, the adhesion to the deposited metal layer is unfavorably unsatisfactory. On the other hand, a total copolymer content exceeding 50% causes remarkably deteriorated sensitivity in printing or excessively strong cohesive force, unfavorably deteriorating the transferability of the ink.

Regarding the molecular weight of the above copolymer, the weight-average molecular weight (Mw) is preferably in the range of form 1000 to 100000, more preferably in the range of from 5000 to 20000. When a plurality of copolymers are used in combination, the weight-average molecular weight of each copolymer is preferably in the above weight-average molecular weight range. When the weight-average molecular weight is less than 1000, the resin is likely to flow even at room temperature, rendering the adhesive layer tacky and, consequently, resulting in deteriorated storage stability. On the other hand, when the weight-average molecular weight exceeds 100000, the cohesive force becomes so high that the transferability of the ink is likely to be deteriorated, rendering the thermal transfer recording material containing such an adhesive layer unsuitable for forming a halftone record.

As described above, the use of three types of copolymers is preferred form the viewpoint of comonomers constituting the copolymers. Even in the case of copolymers comprising identical comonomers, however, they may be different from each other in either or both of comonomer ratio and molecular weight. Therefore, it is also possible to use a plurality of copolymers which are identical to each other in comonomers but different from each other in comonomer ratio and/or molecular weight.

The thickness of the adhesive layer is suitably in the range of from 0.5 to 5 $g/m^2$, preferably in the range of from 1 to 3 $g/m^2$, in terms of the coverage. When the thickness is less than 0.5 $g/m^2$ , no satisfactory adhesion can be provided, resulting in unsatisfactory sensitivity in printing. On the other hand, when it exceeds 5 $g/m^2$, very large energy becomes necessary for melting the adhesive layer and, at the same time, the transferability of the ink is unfavorably deteriorated.

As described above, according to the above embodiment, the use of a specific copolymer in the adhesive layer can offer a good balance between the adhesion (to the deposited metal layer and the adherend) and the cohesive force of the adhesive layer, good sensitivity in printing, and record a letter, a figure or the like as an aggregate of fine patterns by means of a thermal head. Further, since fine pattern recording is possible, the formation of a halftone record by taking advantage of area gradation is possible. Consequently, it is possible to provide a record having metallic luster and a halftone record.

Recording Method

The recording method, wherein the above thermal transfer recording material for imparting metallic luster is utilized to form a record having metallic luster, according to the present invention will be described. According to the recording method of the present invention, a layer having metallic luster is first transferred from the above thermal transfer recording material to form a transferred area, and a record layer of an ink is formed on the transferred area having a layer possessing metallic luster. In this case, the record layer should have transparency high enough not to hide the underlying layer having metallic luster. The record layer may be formed on the whole transferred area or part of the transferred area and, if necessary, on an additional area other than the transferred area.

In the formation of the record layer of an ink on the transferred area, since the transferred area is receptive to an ink, various printing means, such as offset, gravure, and silk screen printing, may be used so far as the resultant record layer has suitable transparency. The thermal transfer recording material for imparting metallic luster according to the present invention has a construction wherein the use of a sublimation type thermal transfer ink or a melt type thermal transfer ink has been taken into consideration. Therefore, thermal transfer printing is preferred wherein sublimation thermal transfer or melt thermal transfer is conducted by means of a conventional thermal transfer printer using a thermal head. As compared with the use of the above various printing means, the use of a printer enables a different image to be easily formed for each record.

The color of the record layer is not particularly limited to chromatic colors and may be any color such as a single color of black or a combination of two colors. Further, the expression of the color is not limited to full-color form. In all the above cases, the advantage of the layer having metallic luster and the ink-receptive layer, that is, one of the features of the recording method, according to the present invention, using the above thermal transfer recording material for imparting metallic luster can be satisfactorily offered. In the formation of a record having metallic luster, when a mere metal foil is used as a printing object for an ink, favorable receptivity to an ink cannot be generally expected from such a metal foil. By contrast, the thermal transfer recording material for imparting metallic luster according to the present invention can provide an ink-receptive printing object having metallic luster from any desired printing material independently of the type of the material, such as paper. Further, according to the recording method of the present invention, additional effects unattainable by the prior art can be offered in the expression of a multi-color or full-color image using a plurality of inks.

In the conventional transfer foil for hot stamping, an anchor layer constituted by a deposited metal layer is colored to prepare a chromatic transfer foil. Therefore, it would be considered that the provision of transfer foils having deposited metal layers of yellow, magenta, cyan, and black (process colors) followed by expression of density gradation for each color by taking advantage of the size of dots in the same manner as used in the conventional printing method such as offset printing could provide a full-color record having metallic luster. In this case, however, lamination of another color on one earlier printed color causes the deposited metal layer, formed simultaneously with the formation of the above color, to hide the underlying color, resulting in no expected subtraction color mixing and, hence, making it impossible to express a full color using inks.

By contrast, according to the recording method of the present invention, a layer having metallic luster is previously transferred at once on a necessary area, and, thereafter, each color is superimposed thereon. Therefore, there is no fear of the earlier formed color being hidden by the later formed color, making it possible to express a full color using process colors or a multi-color using any desired colors. Thus, a full color having metallic luster can be expressed, using three primary colors for subtraction color mixing, yellow, magenta, and cyan, and, optionally four process colors of yellow, magenta, cyan, and black used in the conventional thermal transfer recording material, by the conventional printing method used in the expression of a full color.

Preferably, the record layer of the color ink has transparency high enough not to deteriorate the metallic luster offered by the underlying layer having metallic luster. For this reason, the transparency of the record layer, particularly the transparency of each color in the formation of a full-color record using three primary colors for subtraction color mixing, YMC, or YMCBk, is preferably as follows.

Preferably, the transparency is not less than 70% in the wavelength range of from 550 to 780 nm for yellow, not less than 70% in the wavelength range of from 380 to 450 nm and in the wavelength range of from 600 to 780 nm for magenta, and not less than 70% in the wavelength range of from 380 to 550 nm for cyan. For each color, when the transparency is less than 70%, the resultant record is cloudy and has deteriorated metallic luster, making it impossible to provide good subtraction color mixing and, hence, narrowing the reproducible color range. In the case of a black record layer, a certain degree of transparency (about 30 to 50%) is necessary if the reproduction of black having luster is particularly contemplated. However, when the reproduction of a full color is contemplated, satisfactory reproduction can be achieved even in the case of no luster. Therefore, in this case, a transparency of 0% poses no problem. When the transparency is 0%, the underlying layer having metallic luster, if any, is invisible and useless. Therefore, in this case, the provision of the layer having metallic luster may be omitted.

When the expression of a complete natural color is contemplated, the use of the above YMCBk inks is preferred. However, when the formation of a color record having different chromatic effect or the like is contemplated, the inks are not limited to the above color inks.

Thus, the color record having metallic luster according to the present invention can be provided. In the record, the recorded area has a construction comprising, from the top surface thereof, at least an ink record layer, an ink-receptive layer, an anchor layer, a layer having metallic luster, and an adhesive layer laminated on a transfer object, such as paper. In the above construction, the ink-receptive layer may serve also as the anchor layer, and vice versa. Further, a release layer derived from the thermal transfer recording material for imparting metallic luster may be present or absent, or a part of or the whole release layer in the thicknesswise direction thereof may be interposed between the ink-receptive layer and the ink record layer depending upon the form of release of the above release layer in the thermal transfer recording material for imparting metallic luster.

The thermal transfer recording material for imparting metallic luster, recording method, and the record prepared from the thermal transfer recording material according to the present invention will now be described in more detail with reference to the following examples and comparative examples. In the following examples and comparative examples, all "parts" are by weight unless otherwise specified.

Preparation of Thermal Transfer Recording Material for Imparting Metallic Luster

EXAMPLE A1

A 9 $\mu$m-thick polyethylene terephthalate film was provided as a substrate. A back surface layer, of a silicone-modified polyester, having a thickness of 0.2 g/m$^2$ (coverage on a dry basis; the same shall apply hereinafter) was coated on one surface of the substrate, and a release layer, of carnauba wax, having a thickness of 0.5 g/m$^2$, an ink-receptive layer (thickness 0.5 g/m$^2$), having the following composition, for exclusive use as the ink-receptive layer, and an anchor layer (thickness 0.5 g/m$^2$) were coated on the other side of the substrate. Further, a layer, having metallic luster, of a 500 Å-thick deposited aluminum layer was formed on the anchor layer by vacuum deposition, and a 2 g/m$^2$-thick adhesive layer having the following composition was coated on the layer having metallic luster, thereby preparing a thermal transfer recording material for imparting metallic luster according to the present invention.

| Ink-receptive layer (for exclusive use as the ink-receptive layer) | |
|---|---|
| Ethylene/vinyl acetate copolymer | 100 parts |
| Anchor layer | |
| Nitrocellulose | 80 parts |
| Tolylene diisocyanate | 20 parts |
| Adhesive layer | |
| Carnauba wax | 60 parts |
| Ethylene/vinyl acetate copolymer | 40 parts |

EXAMPLES A2 to A4

Thermal transfer recording materials for imparting metallic luster according to the present invention were prepared in the same manner as in Example A1, except that the thickness of the ink-receptive layer was 0.05 g/m$^2$ for Example A2, 15 g/m$^2$ for Example A3, and 30 g/m$^2$ for Example A4.

EXAMPLE A5

A thermal transfer recording material for imparting metallic luster according to the present invention was prepared in the same manner as in Example A1, except that a 1 g/m$^2$-thick layer having the following composition was coated as the ink-receptive layer, the provision of the anchor layer was omitted, and the layer having metallic luster was a 500 Å-thick silver film layer formed by electroless plating.

| Ink-receptive layer (for exclusive use as the ink-receptive layer) | |
|---|---|
| Ethylene/acrylic acid copolymer | 100 parts |

EXAMPLE A6

A thermal transfer recording material for imparting metallic luster according to the present invention was prepared in the same manner as in Example A5, except that a 7 g/m$^2$-thick resin-containing layer having the following composition was used as the layer having metallic luster and the provision of the ink-receptive layer was omitted.

| Layer having metallic luster (resin-containing layer) | |
|---|---|
| Aluminum paste | 70 parts |
| Polyester resin | 30 parts |

EXAMPLE A7

A thermal transfer recording material for imparting metallic luster according to the present invention was prepared in the same manner as in Example A1, except that the ink-receptive layer was omitted and a 2 g/m$^2$-thick anchor layer having the following composition (for use also as an ink-receptive layer) was used as the anchor layer.

| Anchor layer (for use also as ink-receptive layer) | |
|---|---|
| Vinyl chloride/vinyl acetate copolymer | 100 parts |

EXAMPLE A8

A thermal transfer recording material for imparting metallic luster according to the present invention was prepared in the same manner as in Example A7, except that an ink-receptive layer (thickness 3 g/m$^2$), having the following composition, for use as the ink-receptive layer only was coated between the substrate and the anchor layer (for use also as an ink-receptive layer).

| Ink-receptive layer (for use as the ink-receptive layer only) | |
|---|---|
| Polyester resin | 40 parts |
| Vinyl chloride/vinyl acetate copolymer | 59 parts |
| Amino-modified silicone | 0.3 parts |
| Epoxy-modified silicone | 0.7 parts |

EXAMPLE A9

A thermal transfer recording material for imparting metallic luster according to the present invention was prepared in the same manner as in Example A7, except that a 7 g/m$^2$-thick resin-containing layer having the following composition was used as the layer having metallic luster. In this thermal transfer recording material for imparting metallic luster, the anchor layer for use also as an ink-receptive layer functions as an ink-receptive layer.

| Layer having metallic luster (resin-containing layer) | |
|---|---|
| Aluminum paste | 70 parts |
| Polyacrylic ester | 30 parts |

Preparation of Records

The thermal transfer recording materials, for imparting metallic luster, prepared in the examples and thermal transfer color ribbons were used to prepare records.

EXAMPLES A10 to A15

A thermal transfer paper (white) was provided as a transfer material. The thermal transfer recording materials, for imparting metallic luster, prepared in examples A1 to A6 were transferred onto the transfer material by means of a conventional full-color printer using a thermal head to form a transferred area. Subsequently, the following melt type thermal transfer ribbons were used to perform multi-color recording onto the transferred area. Thus, records of Examples A10 to A16 according to the present invention corresponding respectively to Examples A1 to A6 were prepared.

Melt type thermal transfer ribbon: 2 g/m$^2$-thick melt type thermal transfer ink layers having the following respective compositions were coated on the top surface of a 6 $\mu$m-thick polyethylene terephthalate film with a slip layer provided on the back surface thereof.

| | | |
|---|---|---|
| Red ink layer: | carnauba wax | 85 parts |
| | red pigment | 15 parts |
| Green ink layer: | carnauba wax | 85 parts |
| | green pigment | 15 parts |
| Blue ink layer: | carnauba wax | 85 parts |
| | blue pigment | 15 parts |
| Black ink layer: | carnauba wax | 85 parts |
| | black pigment | 15 parts |

EXAMPLE A16

A thermal transfer material for imparting metallic luster was transferred in the same manner as in Example A10 (that is, using the thermal transfer recording material, for imparting metallic luster, prepared in Example A1) to form a transferred area, and the following melt type thermal transfer ribbons were used to perform full-color recording on the transferred area, thereby preparing a record according to the present invention.

| | | |
|---|---|---|
| Yellow ink layer: | carnauba wax | 85 parts |
| | yellow pigment | 15 parts |
| Magenta ink layer: | carnauba wax | 85 parts |
| | magenta pigment | 15 parts |

-continued

| | | |
|---|---|---|
| Cyan ink layer: | carnauba wax | 85 parts |
| | cyan pigment | 15 parts |

EXAMPLE A17

A record according to the present invention was prepared in the same manner as in Example A16, except that the following ink layers were used instead of the ink layers of the melt type thermal transfer ribbon used in Example A16.

| | | |
|---|---|---|
| Yellow ink layer: | carnauba wax | 85 parts |
| | yellow pigment | 15 parts |
| | silica powder | 5 parts |
| Magenta ink layer: | carnauba wax | 85 parts |
| | magenta pigment | 15 parts |
| | silica powder | 5 parts |
| Cyan ink layer: | carnauba wax | 85 parts |
| | cyan pigment | 15 parts |
| | silica powder | 5 parts |

EXAMPLES A18 to A20

Records of Examples A18 to A20 according to the present invention corresponding respectively to Examples A7 to A9 were prepared in the same manner as in Example A16, except that the thermal transfer recording materials, for imparting metallic luster, prepared in Examples A7 to A9 and the following sublimation type thermal transfer ribbon were used to perform full-color recording.

Sublimation type thermal transfer ribbon: 1 g/m$^2$-thick sublimation type thermal transfer ink layers having the following respective compositions were coated on the top surface of a 6 $\mu$m-thick polyethylene terephthalate film with a slip layer provided on the back surface thereof.

| | | |
|---|---|---|
| Yellow ink layer: | yellow disperse dye | 40 parts |
| | EHEC | 60 parts |
| Magenta ink layer: | magenta disperse dye | 40 parts |
| | EHEC | 60 parts |
| Cyan ink layer: | cyan disperse dye | 40 parts |
| | EHEC | 60 parts |

(EHEC: ethylhydroxyethyl cellulose)

COMPARATIVE EXAMPLE A1

A thermal transfer recording material for imparting metallic luster was prepared in the same manner as in Example A1, except that the provision of the ink-receptive layer was omitted. Then, printing of a full-color image was performed in the same manner as in Example A16, thereby preparing a record.

COMPARATIVE EXAMPLE A2

Printing of a full-color image was performed in the same manner as in Comparative Example A1, except that the sublimation type thermal transfer ribbon prepared in Example A18 was used as the ink ribbon. Thus, a record was prepared.

COMPARATIVE EXAMPLE A3

A color thermal transfer recording material, for imparting metallic luster, with respective to three colors of yellow, magenta, and cyan was prepared in the same manner as in Comparative Example A1, except that the anchor layer of Comparative Example A1 was replaced with a colored anchor layer having the following composition. This color thermal transfer recording material was used to print a full-color image on a thermal transfer paper by the same method as used in the conventional full-color printer, thereby preparing a record.

| Anchor layer | |
|---|---|
| Nitrocellulose | 70 parts |
| Tolylene diisocyanate | 20 parts |
| Colorant: disperse dye | 10 parts |

(Color: each of yellow, magenta, and cyan)

COMPARATIVE EXAMPLE A4

A color thermal transfer recording material, for imparting metallic luster, with respect to three colors of yellow, magenta, and cyan was prepared in the same manner as in Example A6, except that a 7 g/m$^2$-thick, colored resin-containing layer having the following composition was used as the layer having metallic luster. This color thermal transfer recording material was used in the same manner as in Comparative Example A3 to prepare a record.

| Layer having metallic luster (resin-containing layer) | |
|---|---|
| Aluminum paste | 60 parts |
| Polyester resin | 20 parts |
| Colorant: color pigment | 20 parts |

(Color: each of yellow, magenta, and cyan)

Evaluation of Performance

The evaluation of performance in the above examples and comparative examples was conducted according to the following criteria.

I. Sensitivity in transfer of layer having metallic luster (transferability): The layer having metallic luster was transferred onto a thermal transfer paper as a transfer material to form a solid transferred layer. The sensitivity in transfer was evaluated according to the following criteria:

◎: No dropout occurred.

○: Dropout posing no problem occurred.

Δ: Significant dropout occurred.

II. Sensitivity in transfer of color ink (transferability): Solid printing was conducted on an area on which a layer having metallic luster had been transferred. In this case, the sensitivity in transfer of the color ink was evaluated according to the following criteria:

◎: No dropout occurred.

○: Dropout posing no problem occurred.

Δ: Significant dropout occurred.

×: Printing was substantially impossible.

III. Transparency of color ink record layer: The transparency of the record layer was evaluated in terms of an average value of transmissions at 550 nm, 665 nm, and 780 nm for yellow; at 380 nm, 415 nm, and 450 nm as measured in the wavelength range of from 380 to 450 nm and at 600 nm, 690 nm, and 780 nm as measured in the wavelength range of from 600 to 780 nm for magenta; at 380 nm, 465 nm, and 550 nm for cyan; and at the above 12 points (excluding the same wavelength points) for black.

IV. Color reproduction: Solid printing and expression of gradation on seven colors of yellow, magenta, cyan, and red using magenta+yellow (overprinting of both colors; the same shall apply hereinafter), green using cyan+yellow, blue using cyan+magenta, and black formed by overprinting of the three colors were conducted to evaluate reproduction of full colors. The reproduction was evaluated according to the following criteria:

◎: Good reproduction for each color could be obtained.

○: A site having a lowered color density, a site having dropout, or a site having a blackish color was present although this site posed no problem.

Δ: Sites such as a site having a lowered color density, a site having dropout, or a site having a blackish color were significantly present.

x: Dropout occurred, or color could not be reproduced.

V. Luster: The luster was evaluated according to the following criteria;

○: Specular luster

Δ: Cloudy gloss x: No specular surface

The results of evaluation in the above examples and comparative examples are summarized in Table A1. In the column of "Transparency" in the table, "Y85, M80/85, C85" and the like means that the transparency of yellow is 85%, the transparency of magenta is 80% in the wavelength range of from 380 to 450 nm and 85% in the wavelength range of from 600 to 780 nm, and the transparency of cyan is 85%.

TABLE A1

Comparison of performance between examples and comparative examples

| Record | Thermal transfer recording material | Sensitivity in transfer: Layer with metalic luster | Sensitivity in transfer: Ink | Color ink transparancy (%)* | Full-color reproduction | Specular gloss |
|---|---|---|---|---|---|---|
| Ex. A10 | Ex. A1 | ◎ | ◎ | — | — | ○ |
| Ex. A11 | Ex. A2 | ◎ | ○ | — | — | ○ |
| Ex. A12 | Ex. A3 | ○ | ◎ | — | — | ○ |
| Ex. A13 | Ex. A4 | Δ | ○ | — | — | ○ |
| Ex. A14 | Ex. A5 | ◎ | ◎ | — | — | ○ |
| Ex. A15 | Ex. A6 | ◎ | ◎ | — | — | x |
| Ex. A16 | Ex. A1 | ◎ | ◎ | Y85, M80/85, C85 | ◎ | ○ |
| Ex. A17 | Ex. A1 | ◎ | ◎ | Y60, M55/60, C60 | ○ | Δ |
| Ex. A18 | Ex. A7 | ◎ | ◎ | Y85, M80/85, C85 | ◎ | ○ |
| Ex. A19 | Ex. A8 | ◎ | ◎ | Y85, M80/85, C85 | ◎ | ○ |
| Ex. A20 | Ex. A9 | ◎ | ◎ | Y85, M80/85, C85 | ◎ | x |

TABLE A1-continued

| Comparison of performance between examples and comparative examples | | | | | | |
|---|---|---|---|---|---|---|
| | | Sensitivity in transfer | | | | |
| Record | Thermal transfer recording material | Layer with metalic luster | Ink | Color ink transparancy (%)* | Full-color reproduction | Specular gloss |
| Comp. Ex. A1 | Comp. Ex. A1 | ◎ | Δ | Y85, M80/85, C85 | Δ | ○ |
| Comp. Ex. A2 | Comp. Ex. A2 | ◎ | x | Y85, M80/85, C85 | x | ○ |
| Comp. Ex. A3 | Comp. Ex. A3 | ◎ | — | Y85, M80/85, C85 | x | ○ |
| Comp. Ex. A4 | Comp. Ex. A4 | ◎ | — | Y85, M80/85, C85 | x | x |

As is apparent from Table A1, when the thermal transfer recording materials for imparting metallic luster according to the present invention are used to form color records, the resultant color records have excellent metallic luster and, at the same time, excellent color reproduction.

1. The thermal transfer recording material for imparting metallic luster according to the present invention comprises a layer having metallic luster and an ink-receptive layer, and, by virtue of this construction, the transferred area has metallic luster and is receptive to an ink. The transferred area is suitable as a printing object for a thermal transfer ink, such as a sublimation type thermal transfer ink or a melt type thermal transfer ink.

2. When the layer having metallic luster is constituted by a layer of metal film, such as a deposited metal film, the provision of an anchor layer can improve the adhesion, luster and the like of the layer having metallic luster. When the anchor layer serves also as the ink-receptive layer, the layer construction can be simplified, contributing to a reduction in cost.

3. According to the recording method of the present invention, records, of any desired color, having metallic luster, records, of a multi-color using a plurality of desired colors, having metallic luster, and records, of full color using process colors of yellow, magenta, cyan, and black, having metallic luster can be easily provided, according to a conventional thermal transfer printing method, by taking advantage of the fact that the transferred area provided by the transfer of the above thermal transfer recording material for imparting metallic luster is favorable for use in printing of a thermal transfer ink, such as a sublimation type thermal transfer ink or a melt type thermal transfer ink.

4. In the case of process color inks, when the transparency of each ink record layer is brought to not less than 70%, the print has good metallic luster and, in addition, good color reproduction by subtraction color mixing becomes possible.

5. Further, the record of the present invention can be a record having an image possessing good metallic luster and a color record having good expression of colors such as a full color or multi-color.

EXAMPLE B1

A 9 μm-thick polyethylene terephthalate film was provided as a substrate. A back surface layer, of a silicone-modified polyester, having a thickness of 0.2 g/m$^2$ (coverage on a dry basis; the same shall apply hereinafter) was coated on one surface of the substrate, and a release layer, of carnauba wax, having a thickness of 0.5 g/m$^2$, and a 0.5 g/m$^2$-thick anchor layer, for deposition, of metal polymethacrylate were coated on the other side of the substrate. Further, a 500 Å-thick deposited aluminum layer was formed on the anchor layer, for deposition, by vacuum deposition, and a 2 g/m$^2$ -thick adhesive layer having the following composition was coated on the deposited metal layer. Thus, a thermal transfer recording element for imparting metallic luster according to the present invention was prepared.

| Composition of adhesive layer | |
|---|---|
| Carnauba wax | 60 parts |
| Ethylene/vinyl acetate copolymer (weight-average molecular weight: 1500) | 40 parts |

EXAMPLES B2 to B10 AND COMPATATIVE EXAMPLES B1 to B3

Thermal transfer recording elements of Examples B2 to B10 and Comparative Examples B1 to B3 were prepared in the same manner as in Example B1, except that only the composition of the adhesive layer was varied as specified in Table B1.

TABLE B1

| Thermal transfer recording elements prepared in examples and comparative examples | | | | | |
|---|---|---|---|---|---|
| | Wax component | | Resin component | | |
| | | Proportion (pts.) | | Weight-average mol. wt. | Proportion (pts.) |
| Ex. B1 | CW | 60 | EVA | 1500 | 40 |
| Ex. B2 | CW | 60 | EAA | 2000 | 40 |
| Ex. B3 | PW | 80 | EMAA | 2000 | 20 |
| Ex. B4 | PW | 80 | EVA | 1500 | 20 |
| Ex. B5 | CW | 80 | EAA | 15000 | 20 |
| Ex. B6 | CW | 60 | EAA | 85000 | 40 |
| Ex. B7 | CW | 60 | EMAA | 85000 | 40 |
| Ex. B8 | PW | 80 | EVA | 500 | 20 |
| Ex. B9 | CW | 60 | EMAA | 150000 | 40 |
| Ex. B10 | CW | 30 | EAA | 15000 | 70 |
| Ex. B5' | CW | 80 | EAA | 8000 | 20 |
| Comp. Ex. B1 | PW | 100 | None | — | (0) |
| Comp. Ex. B2 | None | (0) | PAE | 10000 | 100 |
| Comp. Ex. B3 | CW | 60 | PA | 30000 | 40 |

Note) Wax component/CW: carnauba wax
PW: paraffin wax
Resin component/EVA: ethylene/vinyl acetate copolymer
EAA: ethylene/acrylic acid copolymer
EMAA: ethylene/methacrylate copolymer
PAE: polyacrylic ester
PA: polyamide resin

Evaluation of Performance

The performance of the thermal transfer recording elements prepared in the examples and the comparative examples were evaluated by the following methods using a mirror coat paper as a transfer object and a line type head of 200 dpi, manufactured by KYOCERA CORP., as a thermal head.

Sensitivity in printing (transferability): Solid printing was conducted, and the sensitivity in printing was evaluated according to the following criteria:

◎: No dropout occurred.

○: Dropout posing no problem occurred.

Δ: Significant dropout occurred.

x: Printing was substantially impossible.

Sharpness of print: Thin lines of 200 dpi were printed. In this case, the sharpness of the print was evaluated according to the following criteria:

◎: The thin lines could be reproduced.

○: Connection of adjacent lines posing no problem was partially observed.

Δ: Connection of adjacent lines was significant.

x: Thin lines could not be reproduced at all.

Storage stability: A web of 100 m was allowed to stand under environment of temperature 45° C. and humidity 85% RH for one week and under environment of temperature 55° C. and humidity 85% RH for 24 hr and then evaluated for blocking according to the following criteria.

◎: No blocking occurred in the core portion for both the conditions.

○: Blocking to such an extent as will have no influence on printing occurred for any one of the conditions.

Δ: Blocking to such an extent as will have no influence on printing occurred for both the conditions.

x: Blocking to such an extent as will influence printing occurred.

TABLE B2

Comparison of performance of thermal transfer recording elements prepared in examples and comparative examples

| Example | Sensitivity in printing | Sharpness of print | Storage stability |
|---|---|---|---|
| Ex. B1 | ○ | ○ | ○ |
| Ex. B2 | ○ | ○ | ○ |
| Ex. B3 | ◎ | ◎ | ○ |
| Ex. B4 | ◎ | ◎ | ○ |
| Ex. B5 | ◎ | ◎ | ◎ |
| Ex. B6 | ○ | ○ | ◎ |
| Ex. B7 | ○ | ◎ | ◎ |
| Ex. B8 | ◎ | ◎ | X |
| Ex. B9 | Δ | ○ | ◎ |
| Ex. B10 | Δ | Δ | ◎ |
| Ex. B5' | ◎ | ◎ | ◎ |
| Comp. Ex. B1 | X | X | Δ |
| Comp. Ex. B2 | Δ | X | Δ |
| Comp. Ex. B3 | X | X | Δ |

EXAMPLE B11

Halftone printing in gradation scales of 25%, 50%, and 75% was performed using thermal transfer recording elements prepared in Example B5 and Comparative Example B3, a mirror coat paper as a transfer object, and a thermal head of the same type as described above in connection with the above evaluation of performance. The halftone reproduction was evaluated according to the following criteria:

◎: Good expression of gradation could be obtained.

○: Somewhat dropout or unsatisfactory gradation in shadow portion posing no problem occurred.

Δ: Dropout or unsatisfactory gradation in shadow portion was significant.

x: Gradation could not be expressed.

TABLE B3

Comparison of performance of records prepared in examples and comparative examples

| Record | Thermal transfer recording element | Density | Half-tone reproduction |
|---|---|---|---|
| Ex. B11 | Ex. B5 | 25% | ○ |
| Ex. B11 | Ex. B5 | 50% | ◎ |
| Ex. B11 | Ex. B5 | 75% | ○ |
| Comp. Ex. B4 | Comp. Ex. B3 | 25% | X |
| Comp. Ex. B5 | Comp. Ex. B3 | 50% | Δ |
| Comp. Ex. B6 | Comp. Ex. B3 | 75% | X |

As described above, in the thermal transfer recording element for imparting metallic luster according to the present invention, in particular, since the adhesive layer contains a specific resin, the adhesion and cohesion of the adhesive layer can be optimized, offering excellent sensitivity in printing, sharpness of print, and storage stability. By virtue of this feature, transfer recording by taking advantage of an agglomerate of a fine pattern having metallic luster by a thermal head is possible, and excellent halftone reproduction by area gradation can be provided.

The records, according to the present invention, prepared from the above thermal transfer recording elements have metallic luster and excellent halftone reproduction.

We claim:

1. A thermal transfer recording material for imparting metallic luster, comprising: a substrate; and at least an anchor layer for deposition, a deposited metal layer, and an adhesive layer provided in that order on one surface of the substrate, the adhesive layer containing wax and, in addition, at least one component selected from the group consisting of an ethylene/acrylic acid copolymer, an ethylene/methacrylic acid copolymer, and an ethylene/vinyl acetate copolymer, said least one component having a weight-average molecular weight of from 5,000 to 15,000.

2. The thermal transfer recording material according to claim 1, wherein the total content of at least one component selected from the group consisting of an ethylene/acrylic acid copolymer, an ethylene/methacrylic acid copolymer, and an ethylene/vinyl acetate copolymer is 10 to 50% based on the total weight of the adhesive layer.

3. A record having metallic luster, comprising an image recorded using a thermal transfer recording material according to claim 1.

4. A record having metallic luster, comprising an image as a halftone record formed by taking advantage of area gradation using a thermal transfer recording material according to claim 1.

* * * * *